US006018834A

United States Patent [19]

Svensson

[11] Patent Number: 6,018,834

[45] Date of Patent: Feb. 1, 2000

[54] METHOD FOR BUILDING A BRIDGE AND BRIDGE BUILT ACCORDING TO SAID METHOD

[75] Inventor: Lars Svensson, Taby, Sweden

[73] Assignee: Jada AB, Stockholm, Sweden

[21] Appl. No.: 09/068,590

[22] PCT Filed: Nov. 14, 1995

[86] PCT No.: PCT/SE95/01360

§ 371 Date: Jul. 21, 1998

§ 102(e) Date: Jul. 21, 1998

[87] PCT Pub. No.: WO97/18355

PCT Pub. Date: May 22, 1997

[51] Int. Cl.[7] ..... E01D 19/02

[52] U.S. Cl. ..... 14/74.5; 14/21; 14/26; 14/73; 14/73.5; 14/77.1

[58] Field of Search ..... 14/73.5, 74.5, 14/77.1, 78, 73, 26, 21

[56] References Cited

U.S. PATENT DOCUMENTS

| | | | |
|---|---|---|---|
| 11,467 | 7/1854 | Baldwin | 14/74.5 |
| 1,842,136 | 1/1932 | Wichert . | |
| 3,296,638 | 4/1964 | Morlon | 14/74.5 |
| 4,665,578 | 5/1987 | Kawada et al. | 14/1 |
| 4,799,279 | 1/1989 | Muller | 14/77 |
| 4,825,492 | 5/1989 | Zehavi et al. | 14/1 |

OTHER PUBLICATIONS

Derwent's abstract, No. 93–203945/25, week 9325, Abstract of SU, 174392 (Khlopenkov P R), Jun. 23, 1992 (23.06.92).

Derwent's abstract, No. 86–92906/14, week 8614, Abstract od SU, 1178827 (Sibe Motor Road Ins), Sep. 15, 1985 (15.09.85).

*Primary Examiner*—Thomas B. Will
*Assistant Examiner*—Raymond Addie
*Attorney, Agent, or Firm*—Ware, Fressola, Van der Sluys & Adolphson LLP

[57] ABSTRACT

Method for building bridges and bridge built according to the method especially a girder bridge with one, two or more girders or longitudinal beams resting on supports at abutments or the like. The novelty lies therein that the girder or longitudinal beams have end portions extending beyond the supports at the abutments and that between such extending ends and the abutments are arranged anchoring devices which after being fixed to the ends of the extending ends of each girder exert a supporting moment to the portion of the girders between the abutments.

12 Claims, 3 Drawing Sheets

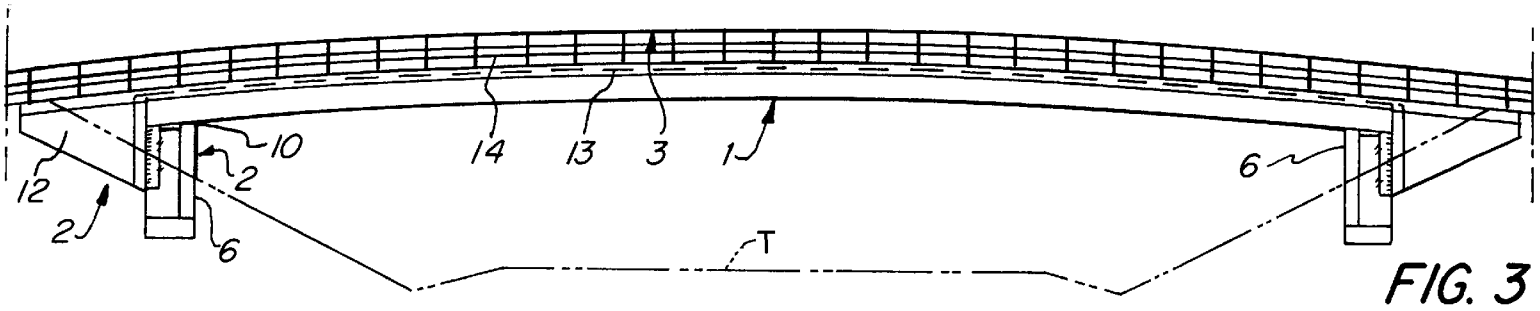
FIG. 1
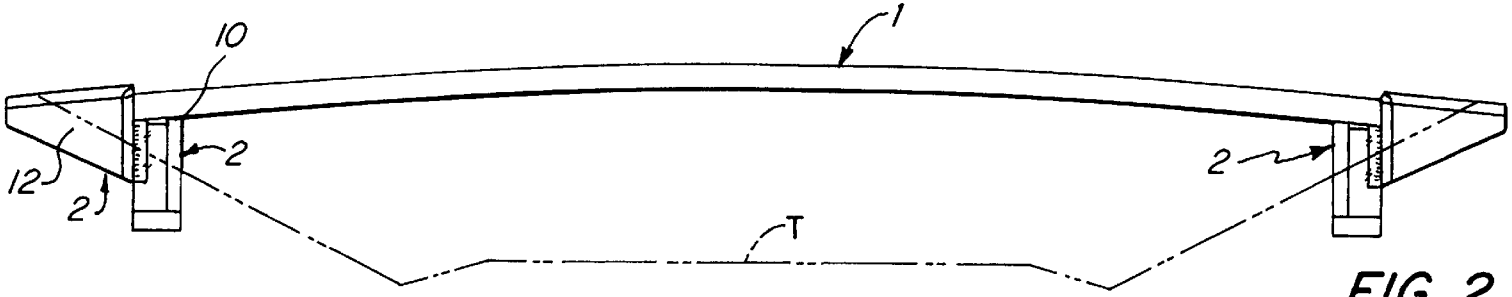
FIG. 2
FIG. 3

(A-A)

METHOD FOR BUILDING A BRIDGE AND BRIDGE BUILT ACCORDING TO SAID METHOD

TECHNICAL FIELD OF THE INVENTION

This invention relates to the building of bridges and especially to the building of girder bridges of the kind where one, two or more longitudinal beams of steels rests against supports at their ends and supports a roadway.

GROUND OF THE INVENTION

Conventional girder bridges have up until now been made as bridges with a main supporting structure of steel or aluminium with or without interaction with the roadway whom the roadway as a rule is made of concrete.

Bridges are loaded by their inherent dead load and by movable load such as traffic load, against its horizontal portions by earth pressure and besides that from movements caused by temperature changes and when concrete is used in composite, also its creep and shrink.

Besides dimensioning the bridges with consideration to strength the deformation of the construction because of traffic load must not exceed given values.

The quality of steel for the supporting girders has been improved so that it has both a highter yield point and is more easily welded. The strength of the new steels qualities cannot be taken advantage of as the allowable deformations of the roadway normally has been used up long before the strength of the steel is fully utilized.

Steel girder bridges because of that will have at large spans high girders with a low exploitation of the potential strength of the steel together with the fact that the volume of steel in the construction is large.

Bridges over existing traffic roads such as roads or railways or waterways normally demand bypass arrangements for existing traffic or temporary closing thereof or speed reductions on the crossing traffic road. Such restrictions of the traffic are very expensive not only with regard to economics because of increased transport work but also from compensations required by the holder of the earlier traffic rights. For instance restrictions in train traffic may result in demands for compensation from the right of way holder to amounts comparable with the building costs for the bridge.

Bridges over for instance railways or motorroads are normally constructed with one or more intermediary supports in order to avoid the need of very heavy main girders as carriers. If such a bridge were to be constructed with only one frame very heavy carring girders would be necessary which from an estetical point of view would be unwanted and result in a construction so heavy that launching out or lifting out of a prefabricated bridge alternatively a partly prefabricated supporting structure were unrealistic.

ASPECTS OF THE INVENTION

One aspect with the invention is to make it possible to build bridges over traffic roads without disturbing the flow of traffic in any essential degree. This means that the works with the bridge abutments in most cases will have to be done without disturbing of the flow of traffic on the lower traffic road and only exceptionally intermediary supports for supporting the bridge girders will have to be done. One aspect is that a bridge over a standard clearance section for railway for fast trains or a bridge crossing a motor road is to be constructed with a minimum influence on traffic, i.e. restriction of traffic during a few hours preferably low traffic hours only.

SUMMARY OF THE INVENTION

The invention is based on the idea that the bridge is made as a frame with a predetermined support moment for dead weight over the frame legs independently of the dimensions of the bridge. This support moment may vary from 0 and up to the value which from the view of the function is the most optimal one.

The predetermined support moment of dead weight is acheived by positioning the entire ready super structure of the bridge or parts thereof including at least the supporting main beams or steal girders freely on the abutments for the bridge. The abutments are made with great stiffness as for example concrete plates. The abutments are provided with supports for the main beams dose to the side of the abutments facing the bridge opening. On the opposite side of each abutment at a distance from the supports of about 2.5 m in the length direction of the bridge, there are in line with each girder position arranged a cavity or recess extending downwardly from the level of the underside of each girder. These cavities are each arranged to receive at least one anchoring device attached to each end of the main girders and preferably at each main girder extending and acting in the direction of each frame leg said anchoring device adapted to the dead weight and/or other predetermined load such as part of the dead weight, in order to create for loads over the predetermined one result in a supporting moment at the main girder in which the predetermined load will result in a corresponding moment in the range of around 0. After having applied the predeterment load, for instance on lifting the main beams in their position resulting in a certain deflection thereof the anchorings are activated which takes place by fixing them by means of concrete filling up the cavites. The result of the load thus provided will be that the support moment of the main girders will be approximately 0 and the load on the under soil over the frame legs will be approximately only vertical resulting in a load on the sub soil or sub ground over the frame leg in a vertical direction only. The result will be a relieving or deloading via the base slab or plate attached to the frame leg, of the unwanted horizontal forces biassing the soil stability of the subground.

The statical function of the bridge wills thanks to the way of arranging the same, to be changed in such a way that the main girders will be tightly clamped, so that the deflection caused by traffic will be smaller, in turn resulting in that the span may be increased without increase of dimensions of the principal load carrying system, in the best case up towards 50% compared with what has been regarded as possible with known building methods and constructions. Motor-roads and bigger trafficroads thereby can be crossed without the use of intermediary supports.

The load added before the securing of the anchoring devices by means of concrete casting, may be applied in different ways for instance by loading the principal load carrying system later on to carry the traffic load or part of the system with a temporary load which can be removed after securing of the anchoring devices. A load may be chosen with different distribution and with different signs in order to reach an optimum result for the bridge. The load may also be equal with a dead weight of the superstructure added in this stage or part thereof.

According to an alternative method the anchoring devices secured to the main girders are fastened to the base plate of the abutments by means of relatively seen weak and adapted to considering the expected function anchoring rods. This method is especially suitable in such cases the superstructure of the bridge is made as in situ cast concrete plate or mounted on the beams in the shape of prefabricated units. During the casting in situ and the assembling of the bridge units, respectively, the beam ends extending beyond the abutments or supports will rise—as the main portion of each beam between the supports is bent down—and this results in a stretching of the anchorings. The anchoring rods are to be dimensioned in such a way in relation to the expected loads that the material of the rods as a result of the loading will be subject to plastic deformation.

This means that the part of the force exerted by the anchoring devices will be dependent on the area and quality of the anchoring material selected and be essentially independent of the length of the anchoring rods or devices. If a concrete or other type of road way was placed on non anchored girders an essential portion of the carrying ability of the main girders would be taken in use for supporting concrete or for the roadway only. By adding a force to the free ends of the girders which force may be varied in any desired way, the field moment of the main girders may be deloaded to any desired extent which increases the space for traffic load.

The method according to the invention results in a maximum utilization of the properties of high quality steel which also means that the bridges can be made so slender that maximum allowable deflection for traffic load can be taken advantage of. Another essential advantage is that the consumption of the steel material will stay close to a minimum and the construction as such compared with other structure will be very cheap.

BRIEF DESCRIPTION OF THE DRAWINGS

The invention will be described in details in the following with references to the attached drawings, in which FIGS. 1, 2 and 3 schematically illustrate in side view the building of a bridge under utilizing a preferred method according to the invention, FIGS. 4, 5 and 6 in a similar way illustrate the building of a bridge according to embodified embodiment of the invention

DETAILED DESCRIPTION OF PREFERRED EMBODIMENTS

Figure 6:
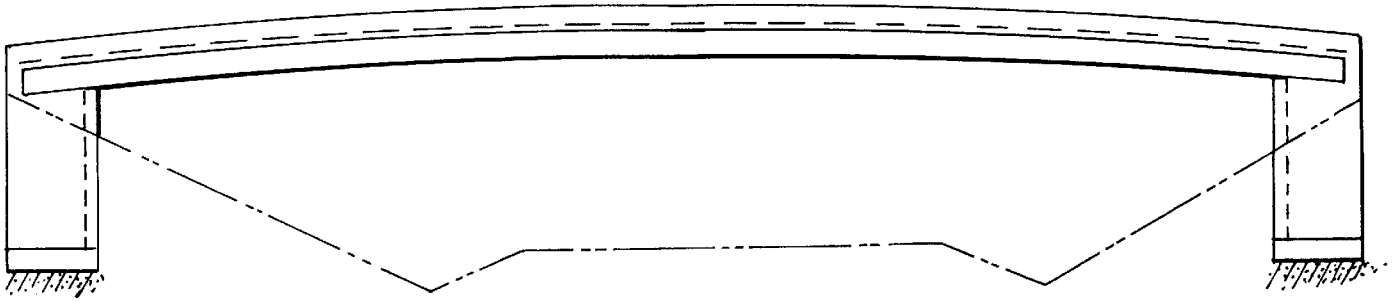

In the drawings T indicates the position of a trafficroad which can be a double track railway, motorway or the like and over this traffic route a bridge is to be erected.

The bridge in its ready state includes a principal load carrying structure 1 consisting of elongated girders, abutments 2, supporting the principal load carrying structure and a superstructure 3 which in turn is supported by the principal load carrying structure 1.

As girders or beams 4 including in the principal load carrying structure 1 are used steel girders of high quality steel. The girders shown are pre bent.

The abutments 2 include a base slab or plate 5. With a limited extension in the length direction of the bridge and on this base slab or plate the abutment proper rests. Each abutment includes a slab shaped central portion 6 and at each end of this there are rearwardly, seen from the position of the bridge, extending side walls 7 at the rear edge of each of which a recess or cavity 8 is arranged. The rear surface of the recess may be provided with per see known pins or the like increasing the shear resistance. Beam supports 10 for the girders 4 are arranged at the upper edge of the central portion. In the illustrated embodiment which include two girders 4 a support 10 is arranged at either end of said surface.

The principal load carrying structure includes in all cases two parallel girders 4 with necessary transfers bindings or bracings.

FIG. 1 illustrates how the girders 4 are set on the supports 10. At the ends of the girders 4 the so called anchoring devices 11 are arranged and they include one or more rods with nobs or the like adhesion increasing projections and the rods are by means of welding secured to the ends of each girder 4. At the girders, which are of I-type in order to provide stiffness between the flanges at the ends of the girder there are preferably mounted, not shown, stiffening plates at each sides of the web. Similar stiffenings may also be arranged opposite the places where each girder engage the supports 10. The anchoring rods 11 extend downwardly into the recesses 8 at the abutments 2 essentially at right angles to the longitudal direction of each girder.

On placing the girders 4 on their supports 10, the girders will change their shapes, bend downwardly and in the embodiment shown become more straight. This results in that the anchoring rods 11 secured to the ends of the girders extending beyond or outside the abutments 2 will be displaced upwardly. After the girders having reached their rest position the anchoring rods 11 are to be secured by casting concrete into the recesses or cavities 8 preferably in connection with the casting of the wing walls 12 or mounting thereof if they are prefabricated.

The bridge deck may be pre mounted on the carrying structure especially if it, which is to be preferred, consists of so called aluminium planks. In the example shown the bridge deck 13 (FIG. 3) will be mounted in connection with the erection of railings 14 and the fitting of other things. The permanent downward deflection is essentially fixed as the extending girder ends are anchored by means of the anchoring rods 11.

The bridge as a whole can after the anchoring of the ends of the girders be regarded as a bar rigidly secured at its ends and this implies that the downward deflection will be of another magnitude than arranging similar girders to rest freely.

After the rigidly fixing at the supports of the anchoring rods attached to the ends of the girders beyond the supports a new load case appears. The girders acting like rods with rigidly secured ends will have a strongly reduced tendency for downward deflection because of a load put thereon.

By the arrangement of the anchoring rods 11, the carrying structure and the supports will co-operate like a unit in such a way that essentially only vertical load will be transferred via the supports to the soil adjacent the supports. The structure does not act as a frame for the dead weight.

Figure 5:
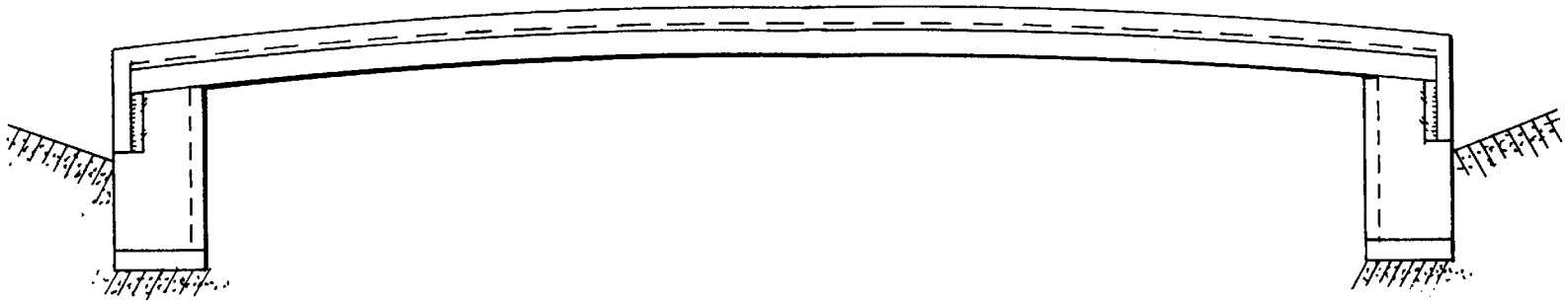
Figure 4:
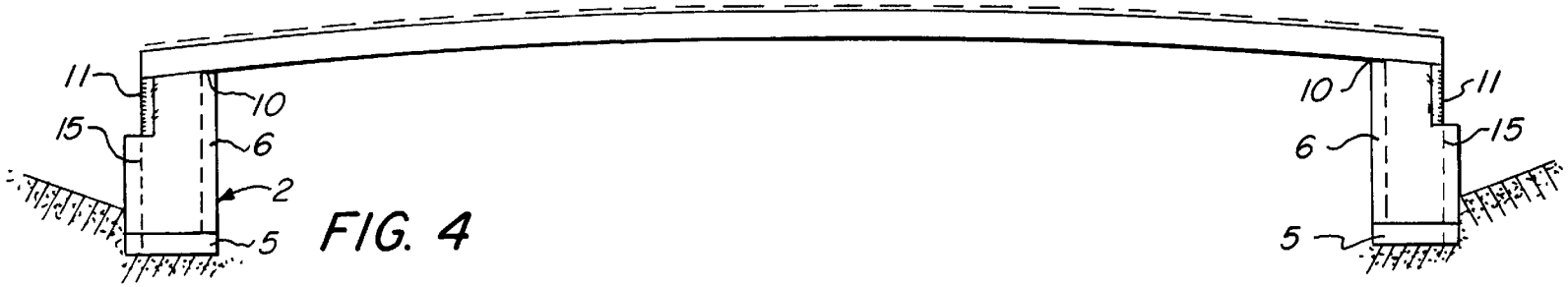
Figure 10:
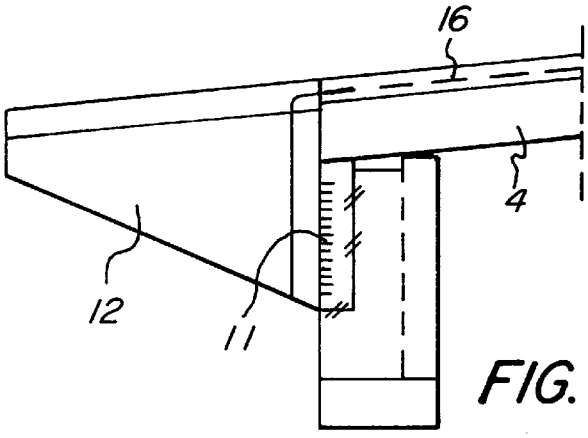
FIGS. 7, 8, 9 and 10 illustrate the procedure of arranging the supports for bridges erected according to the method for the invention
Figure 9:
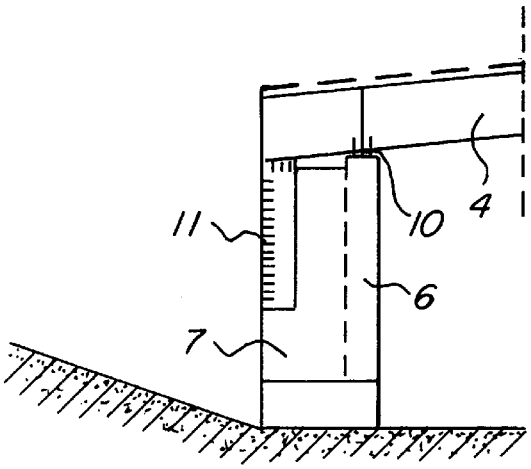
Figure 8:
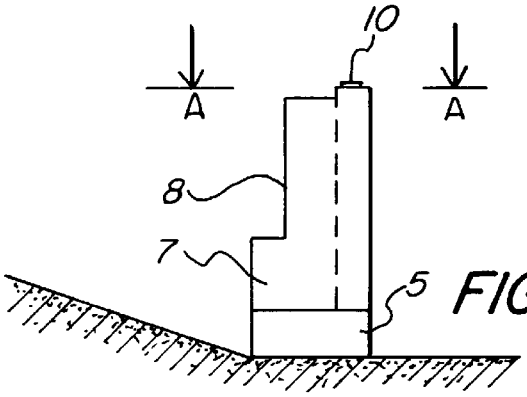
Figure 11:
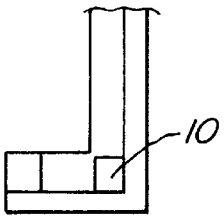
FIG. 11 is a top view showing the support in the arrangement according to FIG. 8.
Figure 7:
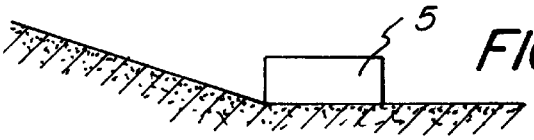

The method illustrated in FIGS. 4–6 starts with a pair of girders 4. The girders are along their upper side provided with pins or the like increasing the adhesion. Besides the anchoring devices 11 of a kind essentially similar with the one of the former examples there are at the ends of the girders 4 also arranged so called temporary anchoring devices 15, which are attached to the support 10, alternatively the base plate 5 and extend upwardly towards each girder end where they are affixed. As a casting of the bridge deck proceeds and the load on the girders 4 results in a downward deflection, the anchorings 15 are more and more put under tension. The dimensioning of the anchorings 15 is so adapted that the material of the rods constituting the anchorings 15 starts to yield. Said rods thereby will create constant or rigid essentially non elastic anti load against the upward movement of the end of the girders caused by the downward deflection of the girder.

After finishing the casting of the bridge deck, the anchoring rods 11 attached to the ends of the beams will be secured by concrete casting in their recesses 8 in a way similar the one described with reference to FIGS. 1–3 and thereupon installation of wing walls, railings and surface coating takes place.

One essential advantage with this method is that, during the casting of the bridge deck, a supporting moment which up to a predetermined limit reduces the downward deflection of the bridge and essentially reduces the field moment is added which contributes to the reduction of material.

In other cases to provide controlled supporting moments influencing the main support structure in same way as in FIGS. 4–6, anchorings devices 15 may be secured to the abutments and stretched towards yield. This can be done with jacks or rams or the like before securing the anchorings towards the ends of the girders. Stretching of the anchoring devices 15 secured to the ends of the girders may also be done by initially placing the girders 4 on provisional supports and raising the girders by means of jacks or the like until the material of the anchorings approaches a yield state and then putting in the permanent supports.

The method according to invention makes ft possible to prepare and arrange the principal load carrying structure, i.e. the girders 4 according to FIGS. 1–3 and in the girders initially included in the mold according to FIGS. 4–6, at a distance from the intended position of the bridge. As soon as the supports have been arranged the entire bridge or the girders with molds, respectively can be lifted to the intended site alternatively be lanced out with no influence but for very marginal on the traffic road below.

I claim:

1. Method of building a bridge comprising the steps of:

(a) providing an abutment on each side of an area to be bridged;

(b) providing a beam support on each abutment;

(c) placing at least one beam on and extending between the supports so that distal ends of the at least one beam extend beyond the supports in a length direction of the bridge;

(d) securing an anchoring device on each distal end of the at least one beam; and (e) further securing each anchoring device to its respective one of the abutments in order to counteract upward displacement of the distal ends caused by downward loads acting on the at least one beam between the supports and provide a supporting moment to the at least one beam.

2. Method according to claim 1, further including the step of loading the at least one beam prior to the further securing step.

3. Method according to claim 1, wherein each abutment is provided with a recess and its respective anchoring device is inserted therein and secured by concrete casting during the further securing step.

4. Method according to claim 2, wherein dead weight of the at least one beam is used as a load during the loading step.

5. Method according to claim 4, wherein, besides the dead weight of the at least one beam, another determined load is used as a load during the loading step before the further securing step.

6. Method according to claim 4, wherein, the further securing step takes place after the load has caused a downward deflection of the at least one beam.

7. Method according to claim 6, further including the step of further loading the at least one beam, the ends of which have been secured during the further securing step, with a predetermined load of a bridge deck resulting in a yielding of material in the anchoring devices.

8. Method according to claim 7, wherein the anchoring devices are secured to a base slab at each abutment.

9. Method according to claim 3, wherein the anchoring devices are secured to adjoining upwardly extending portions of their respective abutments.

10. Method according to claim 7, wherein after the step of placing at least one beam on and extending between the supports, a further anchoring device is secured between each distal end of the at least one beam and its respective one of the abutments and a predetermined load is applied to the at least one beam to cause a yielding of material in each further anchoring device.

11. A bridge comprising:

(a) an abutment on each side of an area to be bridged;

(b) a beam support on each abutment;

(c) at least one beam on and extending between the supports so that distal ends of the at least one beam extend beyond the supports in a length direction of the bridge; and (d) an anchoring device secured on each distal end of the at least one beam and to its respective one of the abutments to counteract upward displacement of the distal ends caused by downward loads acting on the at least one beam between the supports and provide a supporting moment to the at least one beam.

12. Bridge according to claim 11 further including a further anchoring arranged and dimensioned in order to give way by yielding of material and exert a predetermined anchoring force upon application of a predetermined load.

* * * * *

UNITED STATES PATENT AND TRADEMARK OFFICE

CERTIFICATE OF CORRECTION

PATENT NO. : 6,018,834
DATED : February 1, 2000
INVENTOR(S) : Lars Svensson

It is certified that error appears in the above-identified patent and that said Letters Patent is hereby corrected as shown below:

In column 1, line 14, "whom" should be --where--.

In column 2, line 14, "dose" should be --close--.

In column 2, line 42, "wills" should be --will,--.

In column 4, line 7, after "structure", --1-- should be inserted.

In column 5, line 14, after "moment", --is added-- should be inserted.

In column 5, lines 16-17, "is added" should be deleted.

In column 5, line 20, "anchorings" should be --anchoring--.

In column 5, line 28, "anchorings" should be --anchoring devices 15--.

In column 5, line 30, "ft" should be --it--.

In column 6, line 25 (claim 9, line 1), "3" should be --7--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*